US007228782B2

(12) United States Patent
Kim

(10) Patent No.: US 7,228,782 B2
(45) Date of Patent: Jun. 12, 2007

(54) BOOM-HOLDING CONTROL DEVICE FOR USE IN HEAVY CONSTRUCTION EQUIPMENTS

(75) Inventor: Yong Chae Kim, Incheon (KR)

(73) Assignee: Doosan Infracore Co., Ltd., Inchon (KR)

( * ) Notice: Subject to any disclaimer, the term of this patent is extended or adjusted under 35 U.S.C. 154(b) by 0 days.

(21) Appl. No.: 11/319,816

(22) Filed: Dec. 27, 2005

(65) Prior Publication Data

US 2006/0144219 A1 Jul. 6, 2006

(30) Foreign Application Priority Data

Dec. 31, 2004 (KR) ..... 10-2004-0117891

(51) Int. Cl.
*F15B 13/08* (2006.01)

(52) U.S. Cl. ..... 91/445; 91/448

(58) Field of Classification Search ..... 91/444, 91/445, 448; 60/426
See application file for complete search history.

(56) References Cited

U.S. PATENT DOCUMENTS 4,417,502 A * 11/1983 Shore ..... 91/445
5,433,076 A * 7/1995 Sugiyama et al. ..... 91/444
6,691,510 B2 * 2/2004 Kariya et al. ..... 91/445

* cited by examiner

*Primary Examiner*—Michael Leslie
(74) *Attorney, Agent, or Firm*—Lee, Hong, Degerman, Kang & Schmadeka

(57) ABSTRACT

A boom-holding control device brings an excavator boom into a holding condition or a release condition. The device includes a boom-holding valve provided on a fluid pressure line for preventing boom deadweight-caused drainage of a hydraulic flow from a boom cylinder to thereby keep a boom in a holding condition, a boom release valve for releasing the boom from the holding condition in response to at least one of a boom-down pilot signal pressure supplied from a boom cylinder remote control valve and a travel signal pressure fed from a travel control operator-interface device and a solenoid-actuated changeover valve provided on a travel signal line for selectively opening and blocking off the travel signal line. The changeover valve is normally kept in a closing position and will be shifted to an opening position at the time of simultaneous activation of a travel selection switch and a boom release switch.

6 Claims, 4 Drawing Sheets

BOOM-HOLDING CONTROL DEVICE FOR USE IN HEAVY CONSTRUCTION EQUIPMENTS

BACKGROUND OF THE INVENTION

1. Field of the Invention

The present invention is directed to a boom-holding control device for use in heavy construction equipments and more specifically to a boom-holding control device that prevents inertia-caused in-travel raising movement and gravity-caused in-work lowering movement of a boom in heavy construction equipments such as an excavator and the like.

2. Description of the Related Art

In the event that a hydraulic excavator stops its operations with a boom raised up, the boom may be unintentionally lowered under the action of its own weight or the weight of loads carried by a bucket. For the purpose of avoiding such boom lowering phenomenon, the conventional hydraulic excavator is provided with a boom holding valve.

By the way, during the course of travel of the hydraulic excavator, the boom often tends to be shaken up and down by virtue of the joggling of an excavator body, at which time the boom is raised up little by little owing to the self-making-up action of the boom holding valve. The boom thus raised may sometimes mar the visibility of an operator and may become an obstacle in passing through overhead road structures, in which case the operator should stop driving the excavator in an effort to lower down the boom into the original position. In view of such inconvenience, there has been proposed a boom control device of the type as illustrated in FIG. 1.

As can be seen in FIG. 1, the prior art boom control device includes a main fluid pump P1 and an auxiliary pump P2, each of which generates a pressurized hydraulic flow. The hydraulic flow discharged from the main pump P1 is supplied to hydraulic actuators such as a boom cylinder 13, a travel motor (not shown) and the like under a control of a plurality of control spools, including a boom control spool 11 and a travel control spool 12, incorporated in a control valve 10. If a remote control valve 20 applies a boom-up pilot signal pressure ($P_{up}$) to one pressure receiving part, the boom control spool 11 of the control valve 10 is shifted in one direction to allow the hydraulic flow of the main fluid pump P1 to enter the piston-side chamber 13*a* of the boom cylinder 13 to thereby raise up the boom. To the contrary, if the remote control valve 20 applies a boom-down pilot signal pressure ($P_{dn}$) to the other pressure receiving part, the boom control spool 11 of the control valve 10 is shifted in the opposite direction to allow the hydraulic flow of the main fluid pump PI to enter the rod-side chamber 13*b* of the boom cylinder 13 to thereby lower down the boom.

A boom holding valve 15 is connected to a fluid pressure line 14 that interconnects the boom control spool 11 and the piston-side chamber 13*a* of the boom cylinder 13. The boom holding valve 15 includes a poppet 17 slidably fitted into an interior space of the valve in such a manner that the poppet 17 can divide the interior space into a front pressure receiving chamber 15*a*, a lateral pressure receiving chamber 15*b* and a rear pressure receiving chamber 15*c*. A spring 16 is provided on the rear side of the poppet 17 to resiliently bias the poppet 17 toward a position where the front pressure receiving chamber 15*a* is disconnected from the lateral pressure receiving chamber 15*b*. The front pressure receiving chamber 15*a* is in communication with the boom control spool 11 via the fluid pressure line 14 and the rear pressure receiving chamber 15*c* is led to a fluid tank T by way of a boom release valve 19. The lateral pressure receiving chamber 15*b* is in communication with the rear pressure receiving chamber 15*c* through a built-in flow passage 17*a* and also communicates with the piston-side chamber 13*a* of the boom cylinder 13 via the fluid pressure line 14.

The boom release valve 19 has a pressure receiving part 19*a* coupled to the remote control valve 20 through a pilot signal line 21 for reception of the boom-down pilot signal pressure Pdn from the remote control valve 20. The pressure receiving part 19*a* of the boom release valve 19 is also coupled to a travel pedal valve 22 through travel signal lines 23, 24 for reception of a travel signal pressure from the travel pedal valve 22. Reference numeral 25 designates a changeover valve for selectively opening and closing the travel signal line 24 and reference numeral 26 designates a travel selection switch for shifting the position of the changeover valve 25.

If one of the boom-down pilot signal pressure ($P_{dn}$) and the travel signal pressure is exerted on the pressure receiving part 19*a* of the boom release valve 19, the boom release valve 19 moves into a drain position where the rear pressure receiving chamber 15*c* communicates with the fluid tank T to thereby release the boom from a holding condition. If, however, neither the boom-down pilot signal pressure ($P_{dn}$) nor the travel signal pressure is exerted on the pressure receiving part 19*a* of the boom release valve 19, the boom release valve 19 is returned back to a shutoff position, by the action of a spring 19*b*, where the rear pressure receiving chamber 15*c* is disconnected from the fluid tank T to thereby bring the boom into the holding condition.

In this manner, the boom release valve 19 keeps the boom against raising movement while the excavator travels. At this time, however, the boom holding valve 15 remains opened so that the fluid can be drained from the rod-side chamber 13*a* of the boom cylinder 13 through the fluid pressure line 14. This means that the weight of the boom is supported by a bucket that has been retracted toward and placed on a frontal part of an excavator body. Under that state, if the excavator runs over an irregular ground surface and is shaken by the vibration imparted to the excavator body, the bucket is repeatedly bumped against the excavator body, which applies a great deal of oscillatory shock to a buck cylinder particularly during the course of long distance travel of the excavator. This may cause severe damage to the bucket cylinder. For avoidance of such damage, the operator should periodically raise up the boom during traveling to reduce the load of the boom acting on the bucket. Needless to say, this makes the operator feel cumbersome.

SUMMARY OF THE INVENTION

In an effort to eliminate the afore-mentioned and other problems inherent in the prior art devices, the present invention aims at providing a boom-holding control device that can prevent a bucket from receiving excessive loads by the weight of a boom in the course of travel of an excavator, while enabling an operator to release the boom from a holding condition and to lower down the boom into a desired rest position through a simple manipulation without having to stop the travel movement of the excavator, in case that the boom has been unintentionally moved up by in-travel joggling of the excavator.

In one aspect of the present invention, there is provided a boom-holding control device for use in heavy construction equipments, comprising: a boom-holding valve provided on a fluid pressure line interconnecting a boom control spool and a piston-side chamber of a boom cylinder for preventing boom deadweight-caused drainage of a hydraulic flow from the piston-side chamber to thereby keep a boom in a holding condition; a boom release valve for releasing the boom from the holding condition in response to at least one of a boom-down pilot signal pressure supplied from a boom cylinder remote control valve and a travel signal pressure fed from a travel control operator-interface device; a solenoid-actuated changeover valve provided on a travel signal line interconnecting the travel control device and a pressure receiving part of the boom-holding valve for selectively opening and blocking off the travel signal line; a travel selection switch for issuing electric travel signals when activated to assume a travel position; and a boom release switch for generating electric boom release signals when activated to assume a boom release position, wherein the solenoid-actuated changeover valve is shifted to an opening position to release the boom from the holding condition at the time of simultaneous activation of the travel selection switch and the boom release switch.

It is desirable in a preferred embodiment of the present invention that boom-holding control device further comprise a controller for shifting the solenoid-actuated changeover valve into the opening position when the electric travel signals and the electric boom release signals are concurrently inputted from the travel selection switch and the boom release switch.

It is desirable in a preferred embodiment of the present invention that the controller be adapted to cyclically keep the solenoid-actuated changeover valve in the opening position for a predetermined time period at a predetermined interval when the electric travel signals and the electric boom release signals are concurrently inputted from the travel selection switch and the boom release switch.

It is desirable in a preferred embodiment of the present invention that the controller has a time selection means for selecting the predetermined time period during which the changeover valve remains in the opening position by the controller.

In another aspect of the present invention, there is provided a boom-holding control device for use in heavy construction equipments, comprising: a boom-holding valve provided on a fluid pressure line interconnecting a boom control spool and a piston-side chamber of a boom cylinder for preventing boom deadweight-caused drainage of a hydraulic flow from the piston-side chamber to thereby keep a boom in a holding condition; a boom release valve for releasing the boom from the holding condition in response to at least one of a boom-down pilot signal pressure supplied from a boom cylinder remote control valve and a travel signal pressure fed from a travel control operator-interface device; a solenoid-actuated changeover valve provided on a travel signal line interconnecting the travel control device and a pressure receiving part of the boom-holding valve for selectively opening and blocking off the travel signal line; a travel selection switch for issuing electric travel signals when activated to assume a travel position; and a controller for cyclically keeping the solenoid-actuated changeover valve in an opening position for a predetermined time period at a predetermined interval when the electric travel signals are inputted from the travel selection switch.

In a further aspect of the present invention, there is provided a boom-holding control device for use in heavy construction equipments, comprising: a boom-holding valve provided on a fluid pressure line interconnecting a boom control spool and a piston-side chamber of a boom cylinder for preventing boom deadweight-caused drainage of a hydraulic flow from the piston-side chamber to thereby keep a boom in a holding condition; a boom release valve for releasing the boom from the holding condition in response to at least one of a boom-down pilot signal pressure supplied from a boom cylinder remote control valve and a travel signal pressure fed from a travel control operator-interface device; a solenoid-actuated changeover valve provided on a travel signal line interconnecting the travel control device and a pressure receiving part of the boom-holding valve for selectively opening and blocking off the travel signal line; a travel selection switch for issuing electric travel signals when activated to assume a travel position; a boom release switch for generating electric boom release signals when activated to assume a boom release position; a controller including an automatic mode part for supplying electric signals to a solenoid part of the changeover valve to cyclically keep the changeover valve in an opening position for a predetermined time period at a predetermined interval when the electric travel signals and the electric boom release signals are concurrently inputted from the travel selection switch and the boom release switch and a manual mode part for supplying electric signals to the solenoid part of the changeover valve to continuously keep the changeover valve in the opening position for a predetermined time period when the electric travel signals and the electric boom release signals are concurrently inputted from the travel selection switch and the boom release switch; and a mode selection switch for allowing an operator to select one of the automatic mode part and the manual mode part.

According to this aspect of the invention, it is possible for an operator to either automatically or manually release a boom from a holding condition at the operator's will, thus providing convenience in manipulation.

The boom-holding control device of the present invention as summarized above provides a beneficial effect in that, when a boom has been unintentionally raised up in the course of travel of an excavator, the boom can be released from a holding condition and lowered down to a desired rest position by turning on a boom release switch without having to stop traveling movement of the excavator. At this time, the boom is released from the holding condition for a predetermined time period under the control of an electric controller and then returned back to the holding condition in an automated fashion. This prevents a bucket supported on an excavator body from receiving an excessive depression force by the deadweight of the boom, thereby keeping the bucket against damage.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE INVENTION

Now, preferred embodiments of a boom-holding control device in accordance with the present invention will be described in detail with reference to the accompanying drawings.

Figure 1:
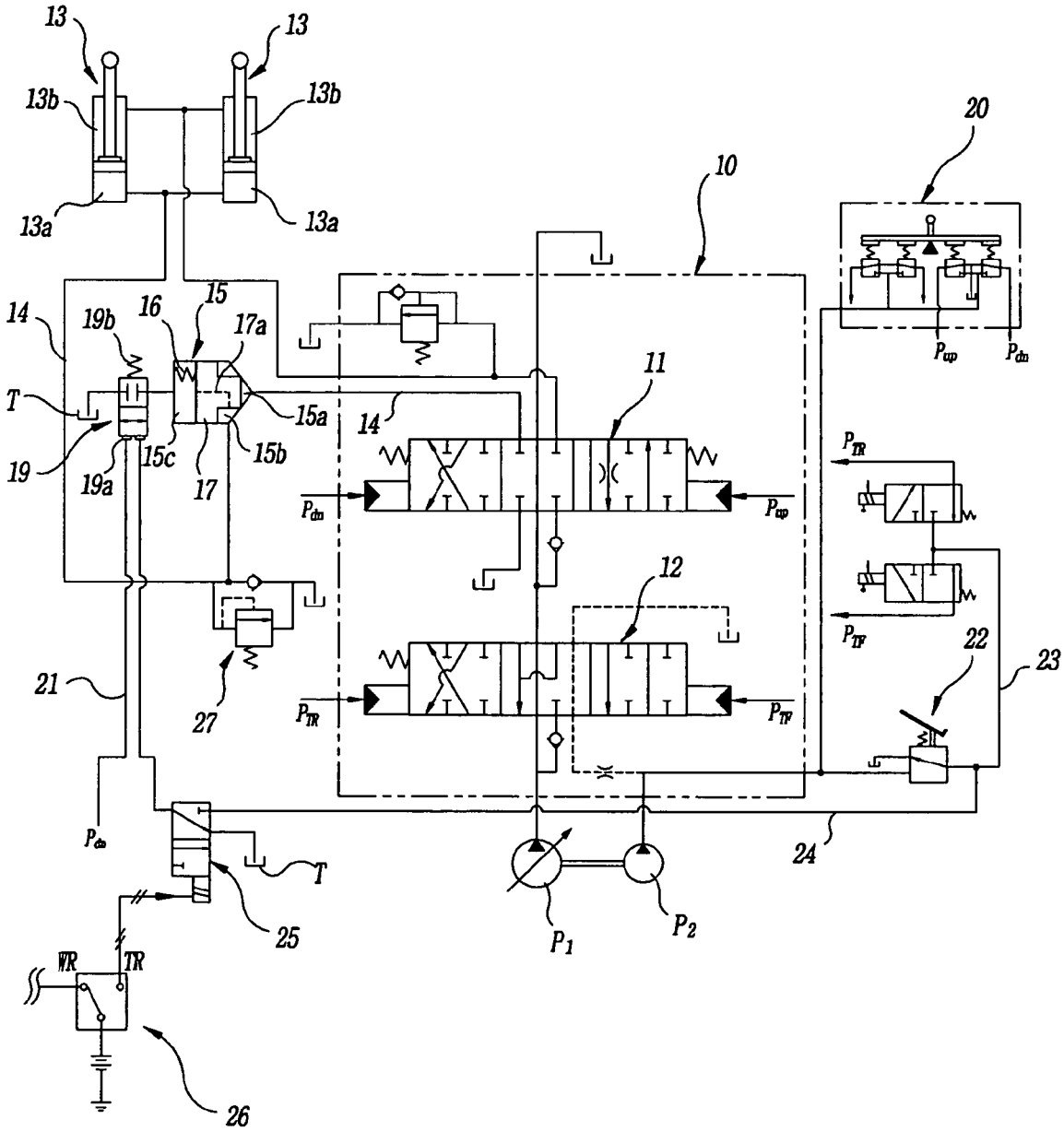
FIG. 1 (PRIOR ART)
FIG. 1 is a fluid pressure circuit diagram showing a boom-holding control device employed in a prior art excavator.
Figure 2:
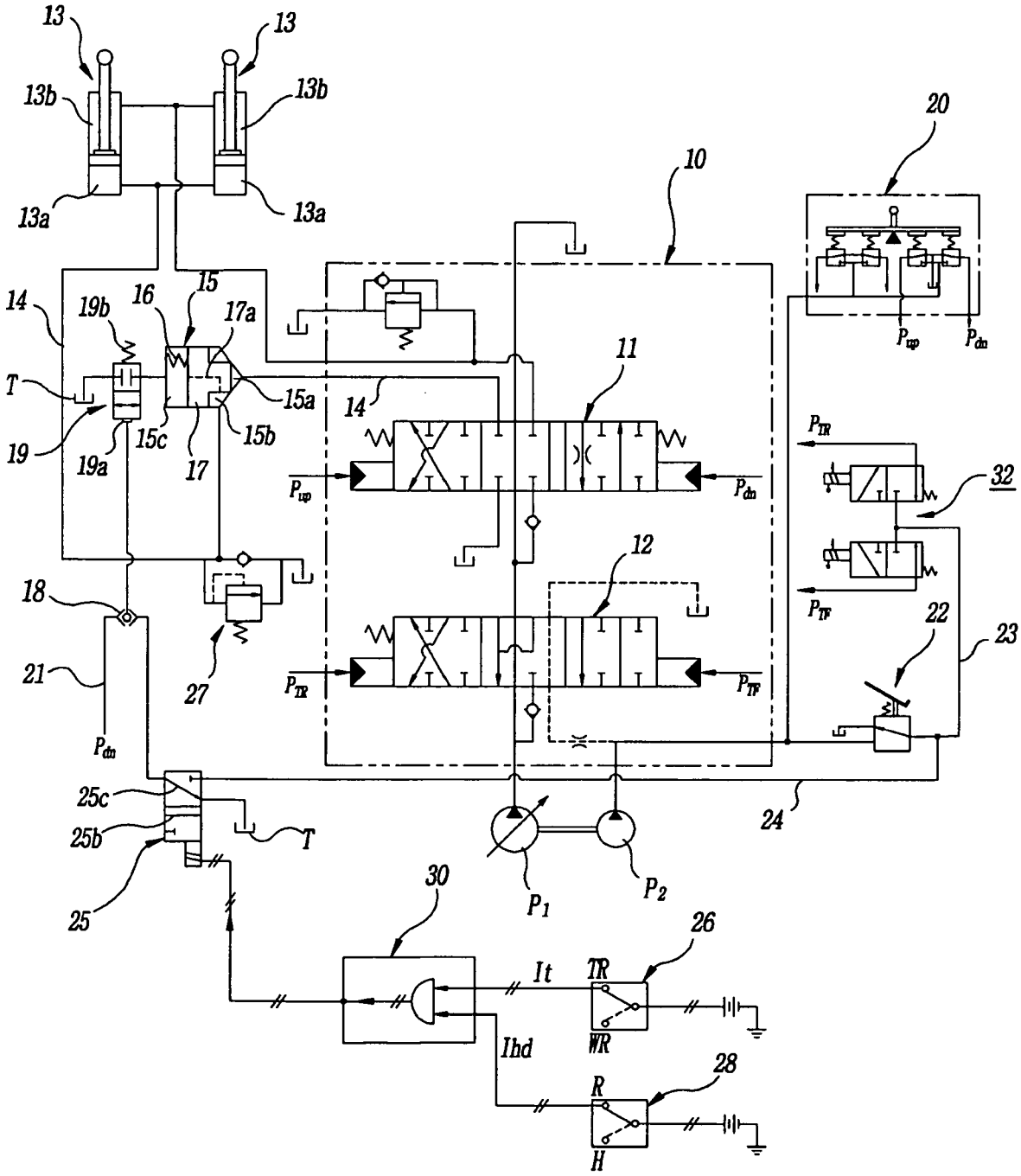
FIG. 2 is a fluid pressure circuit diagram showing one embodiment of a boom-holding control device in accordance with the present invention.

FIG. 2 is a fluid pressure circuit diagram showing one embodiment of a boom-holding control device in accordance with the present invention, which is applied to a wheel-type hydraulic excavator.

The boom-holding control device according to this embodiment comprises a main fluid pump P1 and an auxiliary pump P2, each generating hydraulic flow for actuation of various hydraulic actuators. The hydraulic flow discharged from the main fluid pump P1 is supplied to a boom cylinder 13 and a travel motor (not shown) under the control of a boom control spool 11 and a travel control spool 12 incorporated in a control valve 10. The boom control spool 11 of the control valve 10 is position-controlled by pilot signal pressures ($P_{up}$, $P_{dn}$) issuing from a remote control valve 20, whereas the travel control spool 12 of the control valve 10 is position-controlled by travel signal pressures ($P_{tr}$, $P_{t1}$) issuing from a travel selection valve 32.

If the boom-up pilot signal pressure ($P_{up}$) generated in the remote control valve 20 is exerted on one pressure receiving part of the boom control spool 11, the boom control spool 11 is shifted to the right in FIG. 2, thus allowing the hydraulic flow of the main fluid pump P1 to be supplied to the piston-side chamber 13*a* of the boom cylinder 13 to thereby raise up the boom. On the other hand, if the boom-down pilot signal pressure ($P_{dn}$) generated in the remote control valve 20 is exerted on the other pressure receiving part of the boom control spool 11, the boom control spool 11 is shifted to the left in FIG. 2, thus permitting the hydraulic flow of the main fluid pump P1 to be supplied to the rod-side chamber 13*b* of the boom cylinder 13 to thereby lower down the boom.

A boom-holding valve 15 is provided on the fluid pressure line 14 that interconnects the boom control spool 11 and the piston-side chamber 13*a* of the boom cylinder 13. The boom-holding valve 15 includes a poppet 17 slidably inserted into the interior space of a valve body and normally biased forward by means of a compression spring 16 mounted at the rear side of the poppet 17, thus keeping the boom in a holding condition.

The poppet 17 divides the interior space of the valve body into a front pressure receiving chamber 15*a*, a lateral pressure receiving chamber 15*b* and a rear pressure receiving chamber 15*c*, and is resiliently urged by the spring 16 toward a position where the front pressure receiving chamber 15*a* is disconnected from the lateral pressure receiving chamber 15*b*.

The front pressure receiving chamber 15*a* is in communication with the boom control spool 11 via the fluid pressure line 14. The lateral pressure receiving chamber 15*b* is in communication with the rear pressure receiving chamber 15*c* through a built-in flow passage 17*a* of the poppet 17 and also communicates with the piston-side chamber 13*a* of the boom cylinder 13 via the fluid pressure line 14. The rear pressure receiving chamber 15*c* is led to a fluid tank T by way of a boom release valve 19.

The boom release valve 19 has a pressure receiving part 19*a* connected to a boom release signal supplying means noted below and is normally kept in a shutoff position by the biasing force of a spring 19*b*. Responsive to a boom release signal pressure from the boom release signal supplying means, the boom release valve 19 shifted to a drain position where the fluid in the rear pressure receiving chamber 15*c* of the boom-holding valve 15 is drained to the fluid tank T. This allows the poppet 17 of the boom-holding valve 15 to move backward so that the hydraulic flow in the piston-side chamber 13*a* of the boom cylinder 13 can be drained through the fluid pressure line 14, thereby releasing the boom from a holding condition.

The boom release signal supplying means comprises a shuttle valve 18 that acts to supply the boom release valve 19 with one of the boom-down pilot signal pressure ($P_{dn}$) received from the remote control valve 20 and the travel signal pressure delivered through a travel signal line 24 which is bifurcated from a travel pilot signal line 23 interconnecting a travel pedal valve 22 and a travel selection valve 32.

If one of the boom-down pilot signal pressure ($P_{dn}$) and the travel signal pressure is exerted on the pressure receiving part 19*a* of the boom release valve 19, the boom release valve 19 moves into the drain position where the rear pressure receiving chamber 15*c* communicates with the fluid tank T. This allows the poppet 17 of the boom-holding valve 15 to move backward, thereby releasing the boom from the holding condition. If, however, neither the boom-down pilot signal pressure ($P_{dn}$) nor the travel signal pressure is exerted on the pressure receiving part 19*a* of the boom release valve 19, the boom release valve 19 is returned back to the shutoff position, by the action of the spring 19*b*, where the rear pressure receiving chamber 15*c* is disconnected from the fluid tank T. This permits the poppet 17 of the boom-holding valve 15 to move forward, thereby bringing the boom into the holding condition.

A solenoid-actuated changeover valve 25 is provided on the travel signal line 24 for selectively opening and blocking off the travel signal line 24. The solenoid-actuated changeover valve 25 is shifted to an opening position 25*b* to open the travel signal line 24 if an electric controller 30 applies electric signals to a solenoid part 25*a* of the changeover valve 25, but is returned back to a closing position 25*c* to block off the travel signal line 24 and to eliminate the travel signal pressure from the shuttle valve 18 if the controller 30 applies no electric signal to the solenoid part 25*a* of the changeover valve 25.

In other words, the controller 30 is adapted to apply the electric signals to the solenoid part 25*a* of changeover valve 25 to thereby shift the changeover valve 25 into the opening position 25*b*, thus releasing the boom from the holding condition, when an electric travel signals ($I_t$) and an electric boom release signals ($I_{hd}$) are concurrently inputted from a travel selection switch 26 and a boom release switch 28. If no electric boom release signal ($I_{hd}$) is supplied to the controller 30, the controller 30 applies no electric signal to the solenoid part 25*a* of changeover valve 25 to thereby keep the changeover valve 25 in the closing position 25*c*, thus maintaining the boom at the holding condition.

Normally, the boom-holding control device according to the present invention is adapted to keep the boom in the holding condition during the course of travel of the excavator. This makes it possible to prevent the bucket from bearing excessive loads by the deadweight of the boom.

If there occurs a need to temporarily release the boom from a holding condition during the course of travel in order to lower down the boom which has been raised up by a making-up action, an operator turns on the boom release switch 28 so as to generate the boom release signals. Responsive to the boom release signals, the controller 30 issues electric signals to the changeover valve 25, in response to which the changeover valve 25 opens the travel signal line 24 to allow the travel signal pressure to be delivered to the shuttle valve 18.

Under this condition, the boom release signal pressure is applied to the boom release valve 19 through the travel signal line 24 and therefore the boom is released from the holding condition, making it possible to lower down the boom.

In the manner as set forth above, if the boom needs to be held in place or released from the holding condition while in travel, the operator can perform these tasks by merely activating a switch in a cabin without having to stop traveling movement of the excavator.

Figure 3:
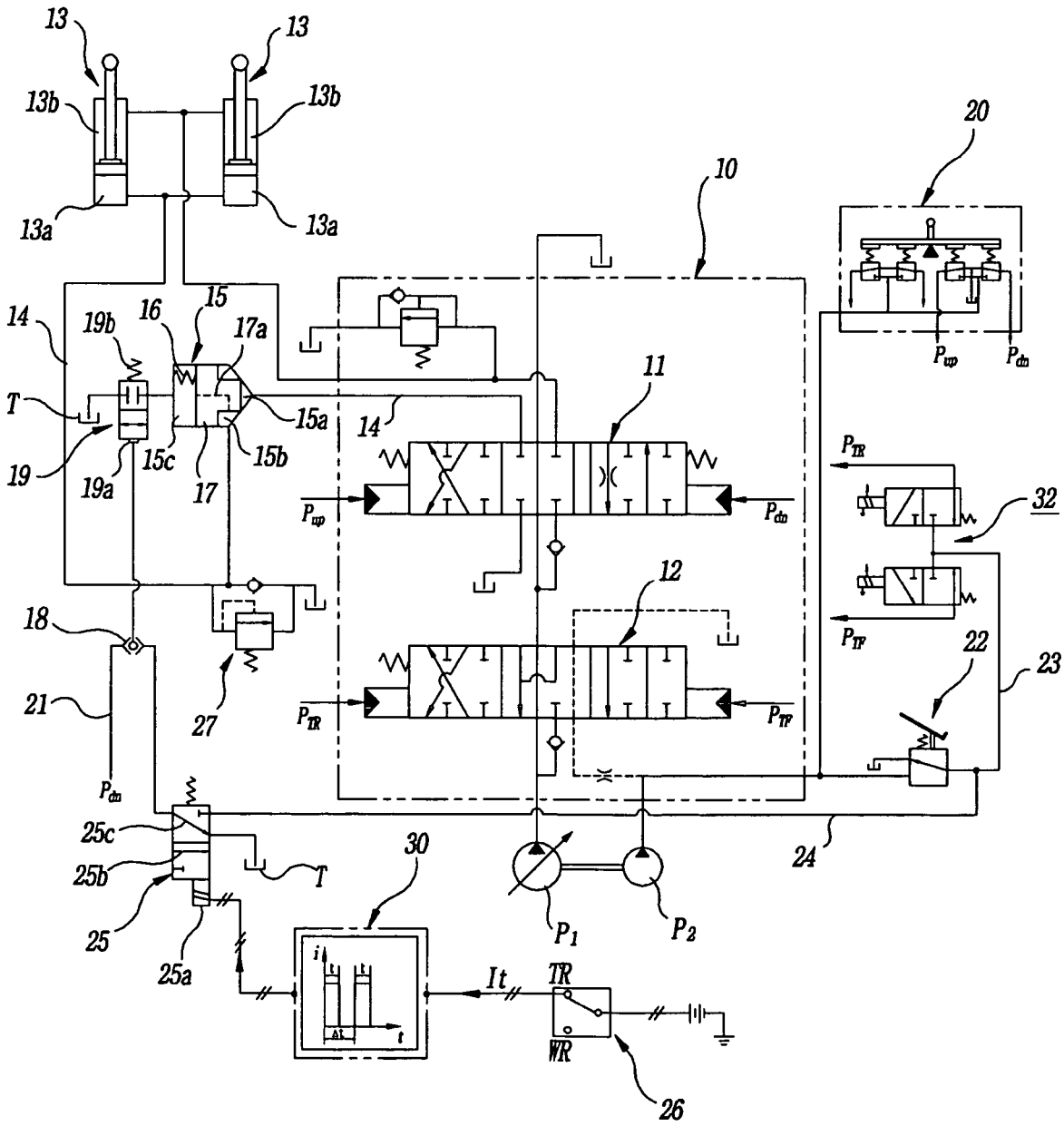
FIG. 3 is a fluid pressure circuit diagram showing another embodiment of a boom-holding control device in accordance with the present invention.

FIG. 3 shows another embodiment of a boom-holding control device in accordance with the present invention, in which embodiment the boom holding and releasing operations are automatically performed at a predetermined time interval. The following description will be centered on those parts that differ from the preceding embodiment and the same parts will not be described for the sake of simplicity.

As shown in FIG. 3, the controller 30 is connected to the solenoid part 25*a* of the changeover valve 25 so that it can supply the solenoid part 25*a* with electric signals to shift the changeover valve 25 to the opening position 25*b*. If the travel selection switch 26 is activated to assume a travel position TR, it generates and inputs electric travel signals $I_t$ to the controller 30. In response, the controller 30 repeatedly applies electric signals to the solenoid part 25*a* of the changeover valve 25 for a predetermined time period (t) at a predetermined interval (Δt).

Specifically, in the automatic control method noted above, if the travel selection switch 26 is activated into the travel position TR and issues the electric travel signals ($I_t$), the controller 30 applies the electric signals to the solenoid part 25*a* of the changeover valve 25 for a predetermined time period (t) at a predetermined interval (Δt) so that the changeover valve 25 can be repeatedly shifted between the opening position 25*b* and the closing position 25*c*. Accordingly, the boom holding condition and the boom release condition are repeatedly switched over in an automated manner.

Figure 4:
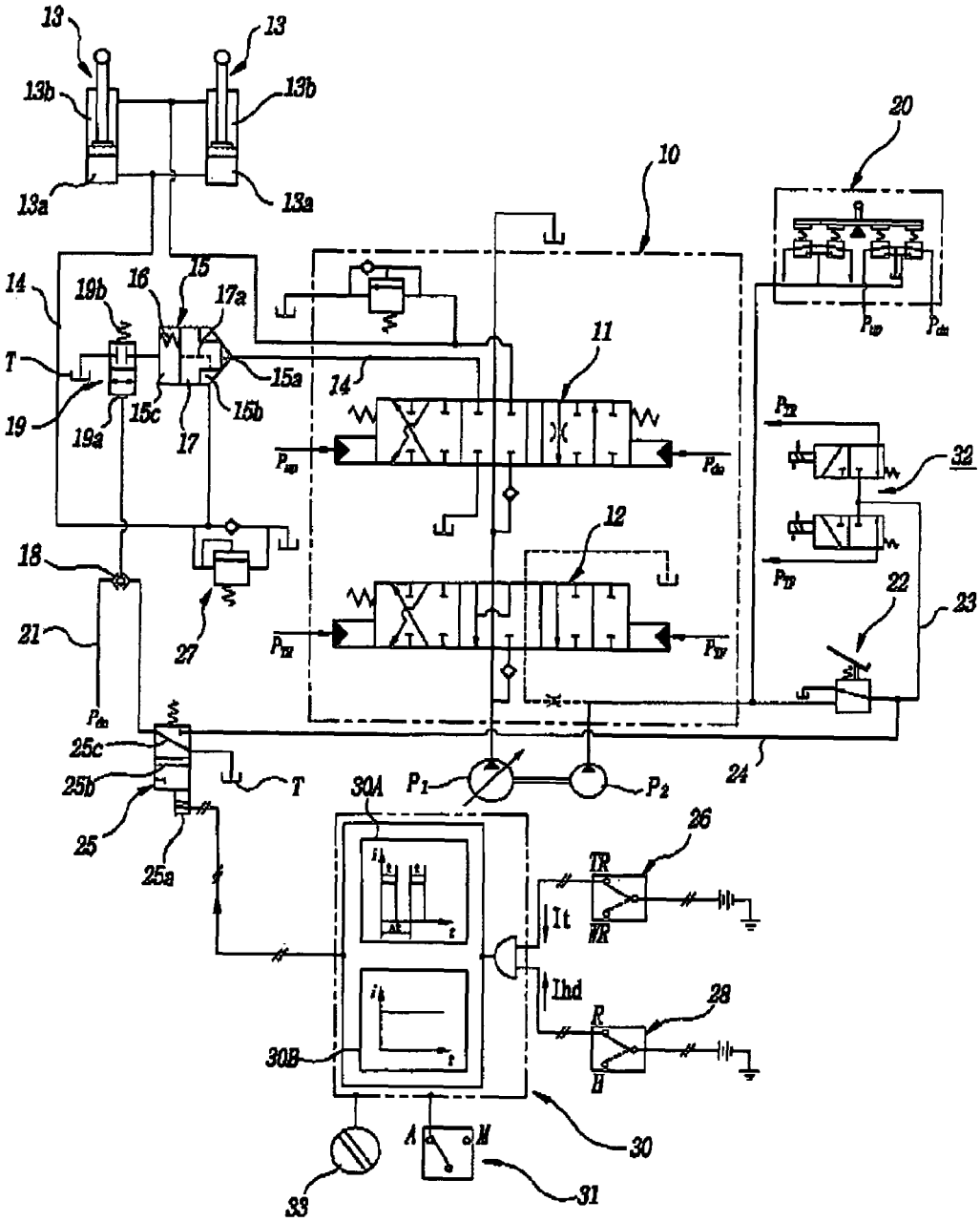
FIG. 4 is a fluid pressure circuit diagram showing a further embodiment of a boom-holding control device in accordance with the present invention.

FIG. 4 shows a further embodiment of a boom-holding control device in accordance with the present invention. In this embodiment, the boom-holding control device has an automatic mode under which the boom holding and releasing operations are automatically performed at a predetermined time interval and a manual mode under which the boom is released from the holding condition only when the operator selects that mode. Mode selection is made by the operator. The following description will be centered on those parts that differ from the embodiment as shown in FIG. 2 and the same parts will not be described for the sake of simplicity.

As is apparent in FIG. 4, the solenoid-actuated changeover valve 25 is provided on the travel signal line 24 that interconnects the travel pedal valve 22 and the pressure receiving part 19*a* of the boom release valve 19. The changeover valve 25 is shiftable between the opening position 25*b* where the travel signal line 24 is opened by the changeover valve 25 and the closing position 25*c* where the changeover valve 25 blocks off the travel signal line 24. The changeover valve 25 is normally kept in the closing position 25*c* and will be shifted to the opening position 25*b* to open the travel signal line 24 in case that the controller 30 applies electric signals to the solenoid part 25*a*.

The controller 30 includes an automatic mode part 30A for supplying electric signals to the solenoid part 25*a* of the changeover valve 25 to cyclically maintain the changeover valve 25 in the opening position 25*b* for a predetermined time period (t) at a predetermined interval (Δt) when the electric travel signals ($I_t$) and the electric boom release signals ($I_{hd}$) are concurrently inputted from the travel selection switch 26 and the boom release switch 28 by activating the switches 26, 28 into the travel position TR and the release position R, respectively, and a manual mode part 30B for supplying electric signals to the solenoid part 25*a* of the changeover valve 25 to continuously keep the changeover valve 25 in the opening position 25*b* for a predetermined time period (t) when the electric travel signals ($I_t$) and the electric boom release signals ($I_{hd}$) are concurrently inputted from the travel selection switch 26 and the boom release switch 28 by activating the switches 26, 28 into the travel position TR and the release position R, respectively. Connected to the controller 30 is a mode selection switch 31 for allowing the operator to select one of the automatic mode part 30A and the manual mode part 30B.

In a nutshell, the boom-holding control device according to the present embodiment is operable either in an automatic mode that automatically repeats the boom holding and the boom release operations or in a manual mode that keeps the boom released only when the operator makes selection of the manual mode. The mode selection switch 31 enables the operator to select one of the automatic mode and the manual mode.

It may be contemplated that a time selection means 33 is connected to the controller 30 for variably selecting the time period (t) that the controller 30 issues the electric signals. The time selection means may be a dial switch or other suitable means and may preferably be provided in a cabin for the operator to manipulate it during the course of driving the excavator.

According to the boom-holding control device of the present invention set forth in the foregoing, a boom can be released from a holding condition automatically or manually in the course of travel of the excavator. This helps to prevent the boom from moving upward by a making-up action during the travel process of the excavator which would otherwise mar the visibility of an operator and increase the overall height of the excavator.

Furthermore, by cyclically performing the boon holding and boom releasing operations at a predetermined interval during long-distance travel of the excavator, it is possible to prevent a bucket supported on an excavator body from receiving an excessive depression force by the deadweight of the boom.

Although certain preferred embodiments of the present invention have been described in the foregoing, it will be apparent to those skilled in the art that various changes or modifications may be made thereto within the scope of the invention defined by the appended claims.

What is claimed is:

1. A boom-holding control device for use in heavy construction equipments, comprising:

a boom-holding valve (15) provided on a fluid pressure line (14) interconnecting a boom control spool (11) and a piston-side chamber (13*a*) of a boom cylinder (13) for preventing boom deadweight-caused drainage of a hydraulic flow from the piston-side chamber (13*a*) to thereby keep a boom in a holding condition;

a boom release valve (19) for releasing the boom from the holding condition in response to at least one of a boom-down pilot signal pressure ($P_{dn}$) supplied from a boom cylinder remote control valve (20) and a travel signal pressure fed from a travel control operator-interface device;

a solenoid-actuated changeover valve (25) provided on a travel signal line (24) interconnecting the travel control device and a pressure receiving part of the boom release valve (19) for selectively opening and blocking off the travel signal line (24);

a travel selection switch (26) for issuing electric travel signals ($I_t$) when activated to assume a travel position (TR); and a boom release switch (28) for generating electric boom release signals ($I_{hd}$) when activated to assume a boom release position (R);

wherein the solenoid-actuated changeover valve (25) is shifted to an opening position (25*b*) to release the boom from the holding condition at the time of simultaneous activation of the travel selection switch (26) and the boom release switch (28).

2. The device as recited in claim 1, further comprising a controller (30) for shifting the solenoid-actuated changeover valve (25) into the opening position (25*b*) when the electric travel signals ($I_t$) and the electric boom release signals ($I_{hd}$) are concurrently inputted from the travel selection switch (26) and the boom release switch (28).

3. The device as recited in claim 2, wherein the controller (30) is adapted to cyclically keep the solenoid-actuated changeover valve (25) in the opening position (25*b*) for a predetermined time period (t) at a predetermined interval (Δt) when the electric travel signals ($I_t$) and the electric boom release signals ($I_{hd}$) are concurrently inputted from the travel selection switch (26) and the boom release switch (28).

4. The device as recited in claim 3, wherein the controller (30) has a time selection means for selecting the predetermined time period (t) during which the changeover valve (25) remains in the opening position 25*b* by the controller (30).

5. A boom-holding control device for use in heavy construction equipments, comprising:

a boom-holding valve (15) provided on a fluid pressure line (14) interconnecting a boom control spool (11) and a piston-side chamber (13*a*) of a boom cylinder (13) for preventing boom deadweight-caused drainage of a hydraulic flow from the piston-side chamber (13*a*) to thereby keep a boom in a holding condition;

a boom release valve (19) for releasing the boom from the holding condition in response to at least one of a boom-down pilot signal pressure ($P_{dn}$) supplied from a boom cylinder remote control valve (20) and a travel signal pressure fed from a travel control operator-interface device;

a solenoid-actuated changeover valve (25) provided on a travel signal line (24) interconnecting the travel control device and a pressure receiving part of the boom release valve (19); for selectively opening and blocking off the travel signal line (24);

a travel selection switch (26) for issuing electric travel signals ($I_t$) when activated to assume a travel position (TR); and a controller (30) for cyclically keeping the solenoid-actuated changeover valve (25) in an opening position (25*b*) for a predetermined time period (t) at a predetermined interval (Δt) when the electric travel signals ($I_t$) are inputted from the travel selection switch (26).

6. A boom-holding control device for use in heavy construction equipments, comprising:

a boom-holding valve (15) provided on a fluid pressure line (14) interconnecting a boom control spool (11) and a piston-side chamber (13*a*) of a boom cylinder (13) for preventing boom deadweight-caused drainage of a hydraulic flow from the piston-side chamber (13*a*) to thereby keep a boom in a holding condition;

a boom release valve (19) for releasing the boom from the holding condition in response to at least one of a boom-down pilot signal pressure ($P_{dn}$) supplied from a boom cylinder remote control valve (20) and a travel signal pressure fed from a travel control operator-interface device;

a solenoid-actuated changeover valve (25) provided on a travel signal line (24) interconnecting the travel control device and a pressure receiving part of the boom release valve (19); for selectively opening and blocking off the travel signal line (24);

a travel selection switch (26) for issuing electric travel signals ($I_t$) when activated to assume a travel position (TR);

a boom release switch (28) for generating electric boom release signals ($I_{hd}$) when activated to assume a boom release position (R);

a controller (30) including an automatic mode part (30A) for supplying electric signals to a solenoid part (25*a*) of the changeover valve (25) to cyclically keep the changeover valve (25) in an opening position (25*b*) for a predetermined time period (t) at a predetermined interval (Δt) when the electric travel signals ($I_t$) and the electric boom release signals ($I_{hd}$) are concurrently inputted from the travel selection switch (26) and the boom release switch (28) and a manual mode part (30B) for supplying electric signals to the solenoid part (25*a*) of the changeover valve (25) to continuously keep the changeover valve (25) in the opening position (25*b*) for a predetermined time period (t) when the electric travel signals ($I_t$) and the electric boom release signals ($I_{hd}$) are concurrently inputted from the travel selection switch (26) and the boom release switch (28); and a mode selection switch (31) for allowing an operator to select one of the automatic mode part (30A) and the manual mode part (30B).

* * * * *